US007192025B1

(12) United States Patent
Golicz et al.

(10) Patent No.: US 7,192,025 B1
(45) Date of Patent: Mar. 20, 2007

(54) SHEET FEEDING APPARATUS

(76) Inventors: Roman M Golicz, 25 Indian Dr., Clinton, CT (US) 06413; Stefan G. Golicz, 26 Old Deep River, Rd., Essex, CT (US) 06426

( * ) Notice: Subject to any disclaimer, the term of this patent is extended or adjusted under 35 U.S.C. 154(b) by 0 days.

(21) Appl. No.: 08/962,077

(22) Filed: Sep. 14, 1998

Related U.S. Application Data

(63) Continuation of application No. PCT/US97/05320, filed on Apr. 1, 1997, now abandoned.

(51) Int. Cl.
*B65H 3/04* (2006.01)

(52) U.S. Cl. ..... 271/34

(58) Field of Classification Search ..... 271/34, 271/122, 117, 104, 151
See application file for complete search history.

(56) References Cited

U.S. PATENT DOCUMENTS

| | | | | | |
|---|---|---|---|---|---|
| 3,570,844 | A | | 3/1971 | Anderson et al. | 271/61 |
| 3,981,493 | A | | 9/1976 | Klappenecker et al. | 271/10 |
| 4,772,004 | A | | 9/1988 | Golicz | 271/3.1 |
| 4,844,435 | A | | 7/1989 | Giannetti et al. | 271/10 |
| 4,909,499 | A | | 3/1990 | O'Brien et al. | 270/10 |
| 5,033,729 | A | | 7/1991 | Struthers | 271/10 |
| 5,120,043 | A | * | 6/1992 | Marzullo | 271/117 |
| 5,335,899 | A | | 8/1994 | Golicz | 271/34 |
| 5,342,036 | A | | 8/1994 | Golicz | 271/3.1 |
| 5,472,182 | A | * | 12/1995 | Han | 271/274 |
| 5,709,380 | A | * | 1/1998 | Petocchi et al. | 271/117 |
| 5,809,749 | A | * | 9/1998 | Ruggiero et al. | 53/473 |
| 5,967,512 | A | * | 10/1999 | Irsik | 271/273 |
| 5,971,389 | A | * | 10/1999 | Golicz et al. | 271/34 |

FOREIGN PATENT DOCUMENTS

| | | | | |
|---|---|---|---|---|
| FR | 2593792 | * | 8/1987 | 271/34 |
| GB | 2319767 | | 6/1998 | |
| JP | 0062125 | * | 4/1982 | 271/34 |
| JP | 0097141 | * | 5/1985 | 271/34 |
| JP | 0209329 | * | 8/1990 | 271/34 |

OTHER PUBLICATIONS

Caudill et al, Sheet Paper Feed System, IBM Technical Disclosure Bulletin, vol. 14 No. 5, p. 1445, Oct. 1971.*
Habich et al, Envelope Picker-Separator, IBM Technical Disclosure Bulletin, vol. 19 No. 3, pp. 746-747, Aug. 1976.*

* cited by examiner

*Primary Examiner*—David H. Bollinger
(74) *Attorney, Agent, or Firm*—C. Nessler

(57) ABSTRACT

Apparatus for feeding sheets and other flat articles, especially with varying thickness, or from stacks of varying height, includes a device called a prompter. The prompter (136) comprises a body (137), a drive roller (142), mounted on and driven by shaft (135), an opposing idler roller (141), and a ribbed belt (138) stretched around the rollers. The body pivots about shaft (135) at the driven roller end. The prompter may alternatively feed articles from a stack to a singulator or other device, or it may comprise the driver of a singulator. A prompter (136), used as driver, combines with a retarder (120), called a dancer, to form a singulator (133). The dancer moves back and forth along the article flow path (121), responsive to thickness of articles, or to pull force on an article by a downstream takeaway device, to thereby automatically adjust the gap at the nip (144) of the singulator.

7 Claims, 8 Drawing Sheets

SHEET FEEDING APPARATUS

This application is a continuation of International Application PCT/US97/05320, filed Apr. 1, 1997, now abandoned.

TECHNICAL FIELD

The present invention relates to sheet feeder machines, particularly to devices which feed sheets and other more or less flat articles from a justified stack or preshingled stack.

BACKGROUND ART

Despite the great amount of engineering attention given in the past to the problem of single sheet feeding, there is a continuing need for improved machines, to overcome limitations to error free, high speed sheet feeding.

In particular, improvements are needed in singulating sheets when they are provided to a machine as a stack, and for delivering sheets to singulators in ways which enhance, rather than sometimes make more difficult, their function. Often, it is necessary to have first and second singulators to avoid the tendency for double feeding of sheets.

Better machines are needed for reliably singulating sheets and other articles which vary in thickness or surface character. Articles which cause feeding problems or tend to be damaged include articles having step change in thickness, such as envelopes with flaps fed first, articles with body joints, window envelopes, plastic credit cards affixed to paper sheets, and heavily coated or printed articles, etc.

Most prior art sheet feeding machines have a large number of components. This is disadvantageous, not only because of increased manufacturing cost, but because complexity and multiple degrees of freedom make it difficult to obtain and maintain precision adjustment. Feeding sheets from the top of a stack in prior art machines has typically required complex sets of rollers and adjusting mechanisms. Typically, the elevation of the top of the stack must be maintained, as by continuously raising the stack. Alternatively, the stack is inclined on edge to make the sheets partially shingled. There is a need for simplification.

Retarders for singulators also need improvement. When they are soft they tend to wear; when they are abrasive, they tend to scrape the article surface. Debris accretes on retarders, especially toner from printed sheets, causing them to lose effectiveness. Still another deficiency in the prior art is that, when sheets are taken away from a singulator at increased speed, there is a tendency for slipping and rubbing on the surface of articles at either the take-away rollers or singulator.

DISCLOSURE OF THE INVENTION

An object of the invention is to provide simple means for drawing sheets from an input tray in a sheet feeder when the stack height varies, and for subsequently singulating them. A further object is to provide singulator retarders which resist the effect of wear and dirt and may be automatically renewed. Still further objects of the invention include to reliably singulate articles which vary in thickness, both across a particular piece, and from piece to piece; and, to minimize smearing or abrasion of articles being pulled by takeaway devices.

In accord with the invention, a sheet feed apparatus of the type which moves sheets downstream along a flow path comprises a device called a prompter, which prompter comprises a first roller mounted on the shaft running transverse to the flow path, a body pivotable about the shaft at a first end proximate the first roller, a second roller mounted at the second or free end of the body, and an endless belt running around and driven around the rollers.

In one embodiment of the invention, the prompter belt is transversely ribbed to directly engage sheets. The rib cross section and aspect ratio are chosen so the ribs flex during use, to throw off debris that otherwise would accumulate. In another embodiment, the prompter outer end has two spaced apart ribbed wheels to engage the sheets. The wheels are mounted on an axle that is slightly rotatable in the plane transverse to the length of the prompter body, to better adapt to uneven articles being fed.

In further accord with the invention, the prompter is subject to two pivoting moments that apply force to an article being moved along the flow path. The first moment arises from frictional engagement of the prompter body with the rotating drive shaft. The second moment is a function of changing tension in the belt and desirably varies according to resistance to motion of an article.

In different preferred embodiments, the prompter either functions as part of a singulator, or cooperates with a separate singulator located downstream from the second, or outer, end of the prompter. In one embodiment, the prompter first roller and the feed roller of a singulator are mounted on the same rotating shaft. The prompter first roller has a one-way clutch to enable the singulator to take away articles faster than the speed at which the prompter moves them. Preferably, such shaft is journaled in adjustable and removable mounting blocks, to enable precise adjustment and easy replacement of the whole assembly.

A preferred prompter used as the driver in a singulator has a belt with a groove into which fits a retarder. In accord with another aspect of the invention, the retarder is an elastic belt which rises on a slope, from beneath the takeaway table to the singulator nip. The belt is periodically flexed by a plunger, to cause the belt to incrementally move around the otherwise stationary one-way rollers which support it. The plunger has an abrasive surface which frictionally renews the belt surface.

In further accord with the invention, a movable retarder, called a dancer, forms a singulator nip in combination with a driver such as a feed roller or prompter. At rest, the dancer is resiliently biased to be positioned close to, or in very light contact with, the driver. When a sheet or other flat article enters the nip, the dancer, or a portion thereof, moves downstream to a degree sufficient to enable the article to pass through the nip, while retarding any other articles. Thus, the gap in the singulator nip is automatically changed, according to the thickness or unevenness of the article passing through, as the retarder dances back and forth. In alternative embodiments a dancer has either linear motion dancer, or it is mounted at one end so it pivots with a component of the free end motion parallel to the downstream flow path direction.

The preferred dancer is comprised of ah endless belt stretched around high friction rollers mounted at each end of a dancer body. A spring biases the dancer very lightly into contact with the driver, in absence of a sheet in the nip. So, when the driver direction is reversed, the driver engages the otherwise stationary dancer belt and causes it to move around the dancer. Thus, a renewed belt surface is brought to the vicinity of the nip.

Preferably, there is a high speed takeaway device for a singulator or other upstream device is comprised of a motor and roller system having a very low polar moment of inertia, which sharply and substantially reduces speed when engaging a sheet moving at low speed.

The foregoing and other objects, features and advantages of the invention will become more apparent from the following description of the best mode of the invention and accompanying drawings.

MODES FOR CARRYING OUT THE INVENTION

The devices described herein are particularly suited for use with sheet feed apparatus of the type wherein sheets are drawn from the top of a stack of sheets and moved along a flow path, for example, so they pass through a singulator which separates sheets into spaced apart individuals or forms them into a partially overlapping or shingled stream.

The inventions described here will be useful as improvements in prior art types of sheet feeding machines. The inventions are also particularly useful in complex high speed equipment for handling other documents, such as machinery for moving and stuffing envelopes, as described in U.S. Pat. No. 5,809,749, of R. Ruggerio and R. Golicz, entitled "High Speed Envelope Packing Apparatus". Thus, while the preferred embodiments are described in terms of feeding of sheets such as paper, for the generality of the invention, reference to processing sheets will be understood to embrace the processing of other flat or folded objects. The present application describes singulator retarders, that are described in somewhat further detail in applicants' U.S. Pat. No. 5,971,389, filed on even date herewith. The disclosures the foregoing two patents are hereby incorporated by reference.

While the invention herein is described in terms of feeding sheets of paper, it will be understood that in the generality of the invention, reference to sheets will embrace other generally flat objects, such as envelopes, sets of sheets, folded pieces, and other articles made of various materials and having varied thickness and surface textures.

Figure 6:
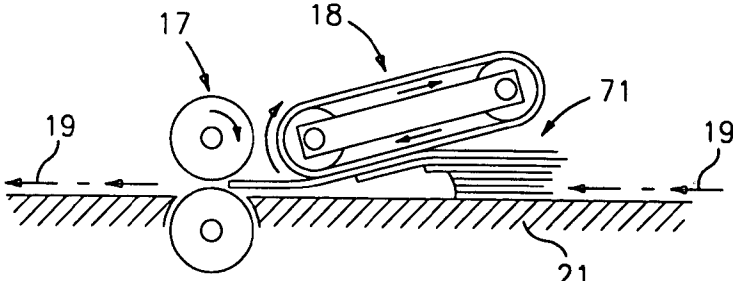
FIG. 6 is a schematic side view showing how a prompter is generally arranged along a flow path with respect to a downstream device such as a singulator.

A key element of the present invention is called a prompter. FIG. 6 illustrates conceptually the functioning of a typical prompter 18 in pulling sheets from a stack 71 and moving them downstream along a flow path 19, from input table 21 to a downstream device such as singulator 17.

Figure 1:
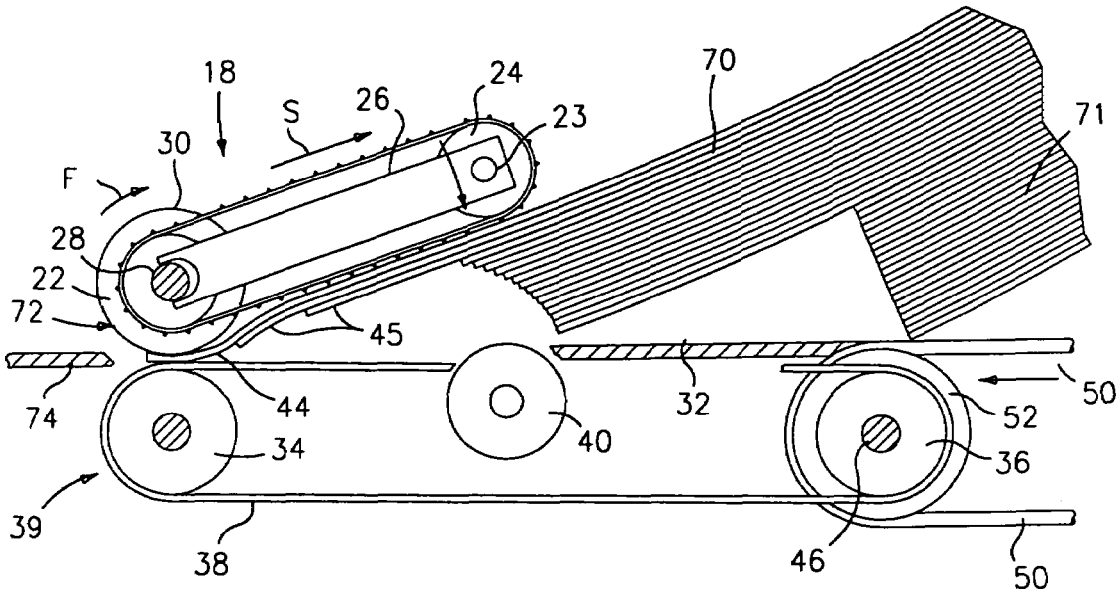
FIG. 1 is a partial cutaway side view of a prompter feeding a stack of sheets to a singulator, the feed roller of which is mounted on the same shaft as the prompter.
Figure 2:
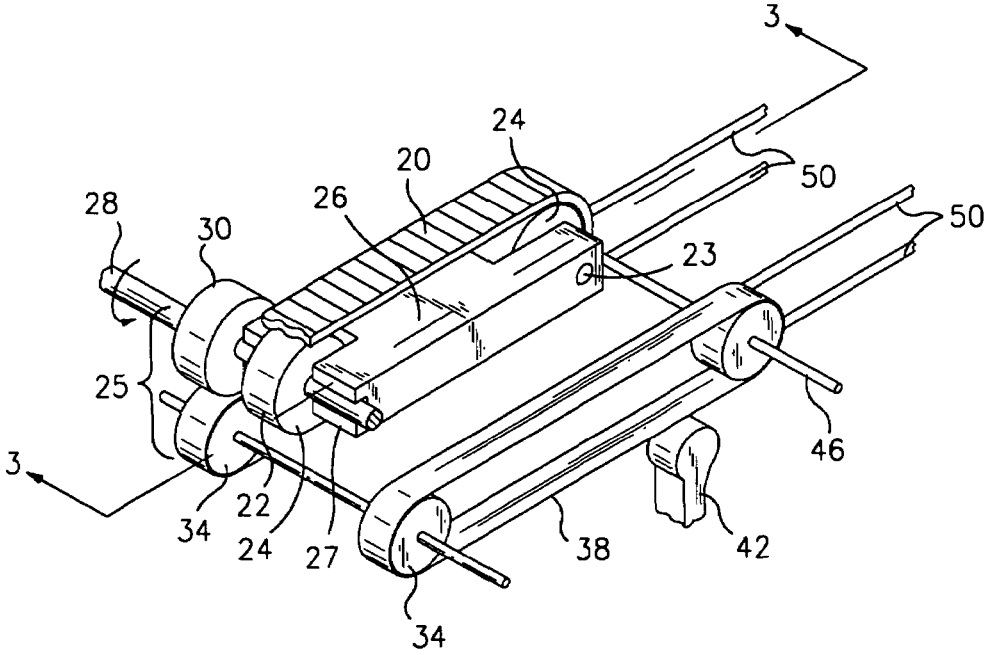
FIG. 2 is a perspective view of a the prompter and singulator of FIG. 1
Figure 3:
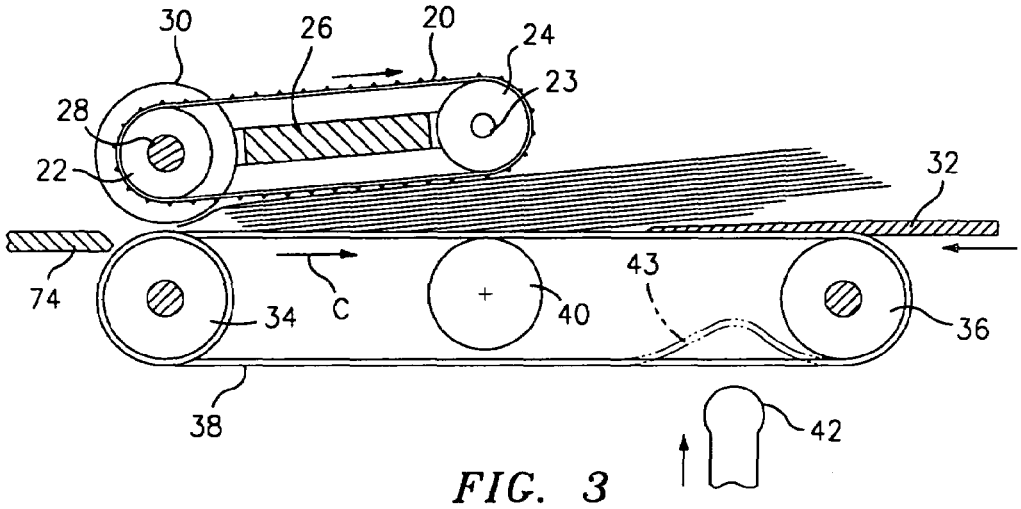
FIG. 3 is a cross section view through the centerline of the apparatus shown in FIG. 2.
Figure 4:
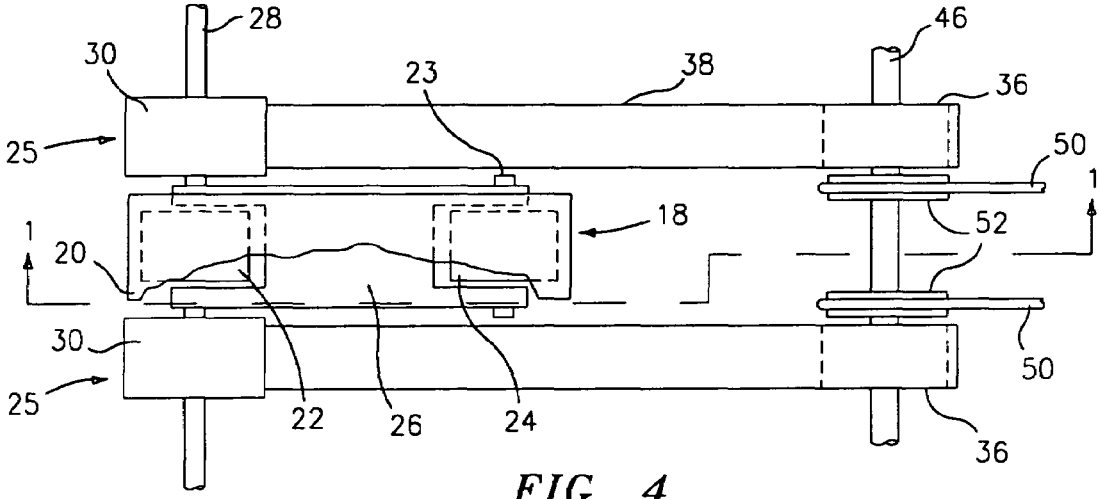
FIG. 4 is a top view of the apparatus shown in FIG. 2.

FIG. 1 shows a preferred prompter which is used in combination with a singulator drivers that share common shaft 28. FIGS. 2–4 are other views of parts of the apparatus of FIG. 1. With reference to the Figures, sheets from a stack 70, lying on infeed table 32, are moved along the flow path, through the singulator nip 72, and onto outfeed table 74, from which they may be removed by other devices. The sheets are drawn to the singulator nip 72 by the prompter 18. The prompter is comprised of a body 26, two rollers 22, 24 and a belt 20. The elastic endless belt 20 is preferably made of an elastomer, such as commercially available 35–40 Durometer natural rubber containing gutta percha with 10–15% carbon black, and it has a coefficient of friction with paper of about 2. Looking downwardly, the body is H-shape, with cutouts to receive rollers at both ends and its body length is aligned with the sheet flow path. The body is made of a composite self-lubricating structural material, such as Nylon with embedded molybdenum disulfide. Roller 22, at the first end 27 of the body, is mounted on shaft 28 by means of an internal one way clutch (also called an overrunning clutch) which enables it to be driven by the shaft in only one direction. Thus, the belt can only be driven to move sheets downstream when shaft 28 is rotated by an unshown motor. Roller 24, at the second end of the body, is rotatable on axle 23, to act as an idler.

Figure 5A:
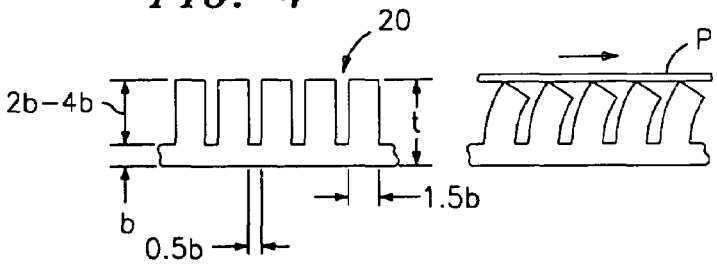
FIG. 5A and FIG. 5B are side views of two different prompter belts. Each Figure shows the transverse ribbing of a free standing belt, on the left, and the ribbing as it deforms when engaging a sheet which resists motion, on the right.
Figure 5B:
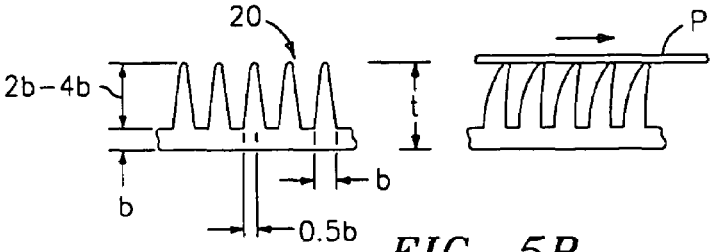

Belt 20 preferably has a surface which has a texture comprised of transverse ribs of triangular cross section rib form, as illustrated by FIG. 5B, or rectangular ribs of FIG. 5A. Each Figure has two fragments: the ribbing of a free standing belt is shown on the left, while the ribbing as it deforms when engaging a sheet which resists motion is shown on the right. The belt material and rib aspect ratio enable the rib tips to significantly bend over when contacting a sheet P, to better engage the sheet surface. This behavior contrasts with what would happen with rounded ribs, or a shallow wave belt surface.

The preferred belt has an overall thickness t of about 3.2 mm (about 0.125 inch) and ribs are geometrically sized as shown in FIGS. 5A and 5B. The rib height to width aspect ratio is (2b to 4b)/1.5b=1.3 to 2.6 for the rectangular shape rib and (2b–4b)/1b=2 to 4 for the triangle cross section. These kinds of ribs are especially advantageous because they keep clean. They continually flex during feeding, to a degree sufficient to slough off the debris, especially toner from electrostatic printed sheets, which typically accretes on feed rollers and belts.

The bifurcated first end 27 of prompter body 26 straddles roller 22. The body is able to pivot about shaft 28, as each leg of the bifurcation has a transverse concave shaped slot to fit the shaft diameter. Belt 20 is stretched over the rollers 22 and 24, so the resultant tensile force in the belt pulls on roller 24 and thus axle 23 and the body 26. Thus, the two slotted legs of end 27 are drawn against the shaft and the resultant friction of the legs with the rotating shaft applies a moment to the body. In the preferred embodiment, where the prompter is feeding sheets horizontally, the first moment adds to gravity, in urging the body downward toward the sheet flow path and surface of the infeed table 32. When no sheets are present at the infeed table, the prompter rotates downward so the belt rests on idler roller 40. See FIGS. 1 and 3.

Figure 7:
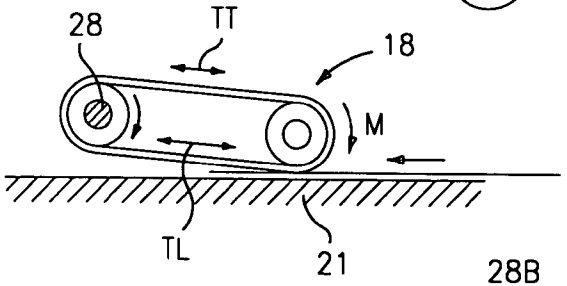
FIG. 7 is a schematic showing forces on a prompter due to engagement of the prompter belt with a sheet.

As illustrated by the schematic of FIG. 7, the prompter is subject to still another desirable rotational moment. When there is a resistance to belt motion due upon frictional engagement with a sheet along the flow path, the tensile force TL in the lower part of the belt will be greater than the tension TT in the upper part of the belt. This imbalance creates a moment M which urges the free end of the body to pivot about shaft 28 toward the flow path of the sheets. Thus, there is a desirable increase in the downward force, and resultant downstream frictional force, on the sheet surface, in proportion to the resistance which the sheet has to downstream motion.

Figure 14:
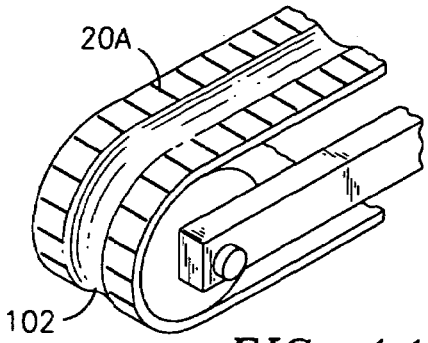
FIG. 14 is a partial perspective view of the downstream end of a prompter belt having a lengthwise groove.

In the generality of the invention, the prompter delivers sheets to any downstream device or receiving point. In the preferred mode, the drive rollers of singulators are co-mounted on shaft 28 with the prompter, and the prompter delivers sheets to the singulator. Shown in FIG. 14, are double singulator assemblies 25, acting in parallel. Each singulator assembly is comprised of a feed roller 30 (also called a driver) and a retarder 39. Each roller 30 has a circumferential driving surface formed of suitable elastomeric material, such as 40–50 Durometer polyurethane; and, an integral one-way roller clutch. Feed rollers 30 are driven by shaft 28, as indicated by arrow F, to move sheets downstream; and, the clutches allow the rollers to freewheel in the direction of the sheet movement if a downstream takeaway device draws sheets from the outfeed table 74 faster than they are being delivered there by the singulator driver rollers. In the generality of this aspect of the invention, the free end of the prompter is located upstream of the device which the prompter is feeding, while the shaft end of the prompter is co-located with the device, e.g., the nip of singulator assembly 25.

In operation, the prompter belt engages any sheet lying along the flow path. As shown in FIG. 1, as the topmost sheet 44 of stack 70 is pulled away, and some underlying sheets 45 will usually be dragged by inter-sheet friction from the stack. At the singulator nip 72, a properly chosen spacing of the retarder belts 38 and feed rollers 30 allow only one sheet to pass through the singulator. From the Figures, it will be appreciated that the prompter 18 is located at an elevation which permits it to reach upwardly to the top of a stack at a first height, and when, due to removal of sheets, the stack height decreases to less than the elevation of the prompter shaft, the prompter draws sheets laterally. It is not illustrated but will be evident that the prompter may reach downwardly, below the elevation of the singulator.

A conveyer resupplies sheets in shingled stacks 70, 71, to the prompter, as illustrated by FIG. 2. Of course, sheets may be supplied as spaced apart stacks or shingled streams as well. As shown in FIGS. 1–4, the conveyer preferably comprises round belts 50 which run along the surface of infeed table 32, from idler rollers 52, mounted on shaft 46, to upstream drive rollers which are not shown.

The singulator assembly feed rollers 30 have a tangential surface speed greater than the belt surface speed since the diameters of rollers 30 are larger than the outside diameter of the prompter belt at roller 22. Thus, when a sheet is simultaneously engaged by the feed rollers and prompter belt, the singulator force on the sheet tends to move the sheet at higher speed than is dictated by the prompter belt speed. This is enabled by the one-way clutch. Less preferably, when a one-way clutch is not used with first roller 22, the sheet may slip relative to the belt or singulator. In either case, tension TL in the lower side of the belt will be reduced, and the downward force applied to the sheet by the prompter is lessened, as a corollary to the relationship previously described in connection with FIG. 7. The lessening of force desirably enables the sheet to be drawn more freely by the feed rollers than otherwise.

Figure 18:
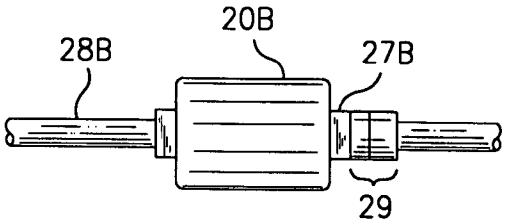
FIG. 18 shows a prompter having a shaft-driven clutch which applies a rotating force to the body.

In an alternate embodiment of the invention illustrated in FIG. 18, first end of the body may be mounted on shaft 28B by frictionless bearings; and, a pivoting moment on the body 27B is achieved by use of one or more slip clutches 29 mounted on the shaft 28B. The slip clutch has a moving part attached to the rotating shaft, and a fixed part attached to the body, so the pivoting force is a function of setting the degree of slip of clutch. The belt 20B may be non-stretchable in this embodiment. Especially for non-horizontal applications, suitable springs, weights and other devices may be employed with or without the mechanisms described above, to lessen or increase the desired rotary force on the prompter which causes it to press onto the surface of sheets being fed.

In the generality of the invention, drive roller 22 may be rotated by means independent of shaft 28, such as a motor and pulley. For any embodiment, while the bifurcated end and H-shape of the body which is shown is much preferred, it will be appreciated that unbifurcated ends, and other shape ends, perhaps with multiple first end rollers, will be substitutional. And, where integral over-running or one way clutches are described other known one-direction devices may be substituted, for example, a pawl may be engaged with the ribbed surface of the prompter belt. Also, in the generality of the invention, it will be understood that in various places different shape belts may be used than are described, and that roller length may be varied, to the point of comprising a wheel.

FIGS. 1–4 also show the preferred form of the two retarders used with the combination of prompter and singulators. Typical retarder 39 is comprised of an elastomeric retard belt 38, such as one made of 60–75 Durometer polyurethane, mounted on rollers 34, 36. Both rollers are mounted on static shafts. At least roller 36, and preferably both rollers, comprise integral one-way roller clutches.

Thus, the top part of the retard belt can only be driven in the upstream direction, indicated by arrow C. See FIG. 3.

The upstream retard roller 36 is somewhat lower in elevation than roller 34, to make the upstream surface of belt 38 lower than the surface of infeed table 32. At the downstream end of the retard assembly, the belt surface rises above the table surface to the desired level for a proper singulating nip with feed roller 30. This feature enables a longer length and thus longer life retard belt, and less inhibition of sheet motion than would occur if the belt ran horizontally.

As sheets pass over the static retard belt proximate the singulator nip, there is a normal tendency for wear and accretion of debris on the belt. A renewed belt surface is achieved by programmed periodic action of plunger 42. The plunger presses vertically against the underside of the belt, tensioning, stretching and then relaxing it, as illustrated by the phantom lines 43 in FIG. 3. On tensioning, the belt moves and slightly rotates roller 36 about shaft 46, while roller 34 cannot move in reverse. On relaxation, the belt slightly rotates roller 34 while roller 36 remains stationary; whereupon, the top portion of the belt moves a small distance in the upstream direction and a new part of the belt surface is exposed proximate the singulator feed roller 30. The end of the plunger 42 which contacts the belt preferably is made of an abrasive stone, so that when the belt is tensioned and relaxed there will be a scraping of the belt surface, to thereby remove any accreted debris. Alternately, the belt may be tensioned and relaxed by other means than the plunger, for instance by a pin which pulls it outwardly.

Figure 9:
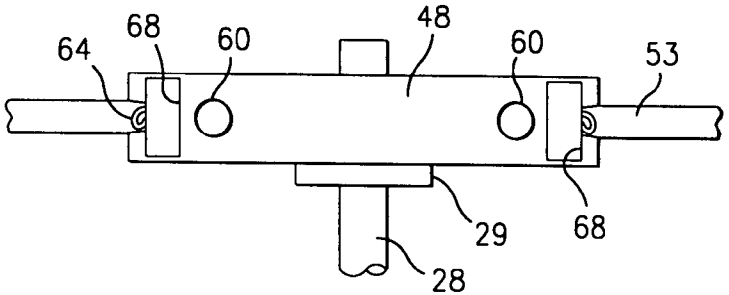
FIG. 9 is a top view of the mounting block of FIG. 8.
Figure 8:
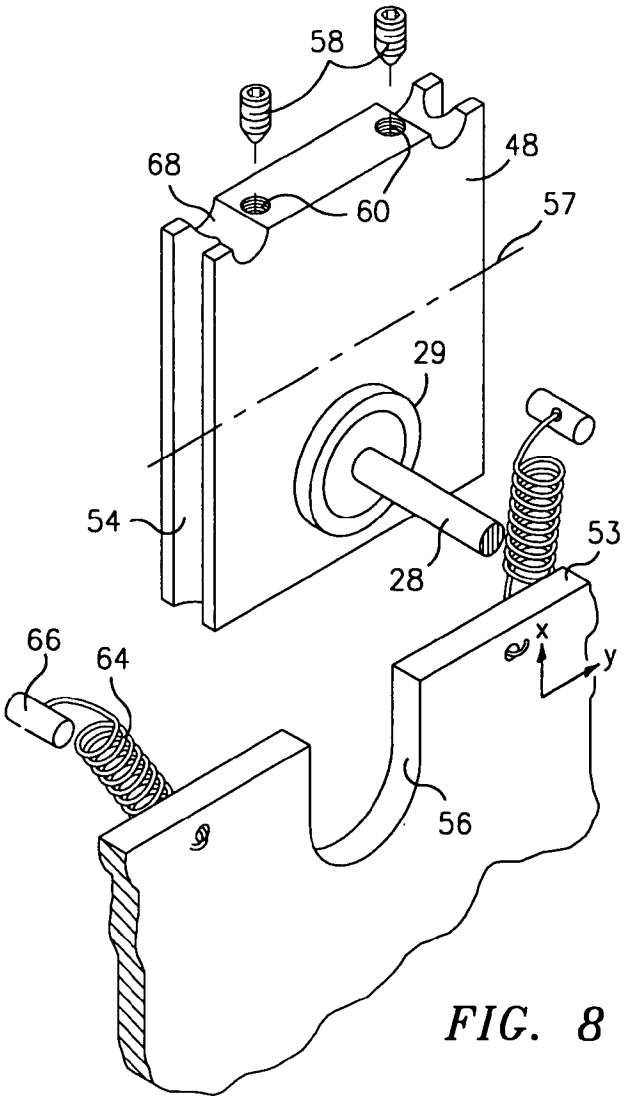
FIG. 8 shows in perspective a mounting block used to hold the shaft of the prompter at an apparatus sidewall.

An advantage of mounting the prompter and singulator feed roller on the same shaft is that the critical components of the system are positively aligned and the entire assembly can be removed, replaced or adjusted readily. To facilitate such, as indicated by the perspective and top views of FIGS. 8 and 9, each end of shaft 28 is mounted in a frictionless bearing 29 which is set in a mounting block 48 that is removable from the side wall 53 of the sheet feeding apparatus. The side wall has a cutout 56 into which the bearing fits.

The bottom of the mounting block is slotted up to the height of the line 57. The resultant spaced apart mounting block walls capture the side wall with a loose fit, so the block can be canted slightly out of the vertical x-y plane. Thus, one end of the shaft can be raised higher than the other, to accommodate articles with uneven thickness from side to side. The mounting block is resiliently held in place by springs 64 which run vertically in grooves 54, to fasten with pawl ends 66 into horizontal grooves 68 on the top of the block. Set screws 58 run in holes 60, to contact the top edge of the sidewall, to enable precise vertical adjustment of the mounting block, and thus the shaft, and thus the singulator nip gap.

Figure 10:
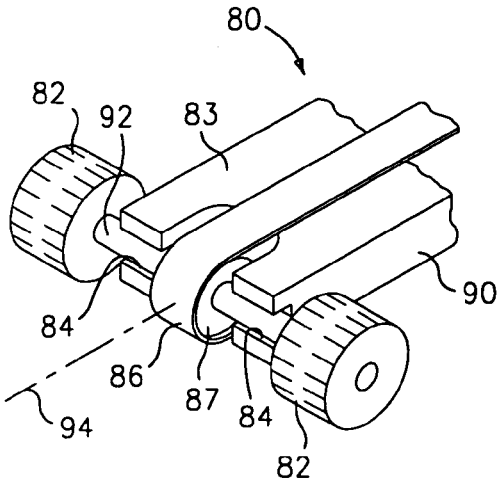
FIG. 10 is a partial perspective view of the upstream end of a prompter having two wheels.
Figure 11:
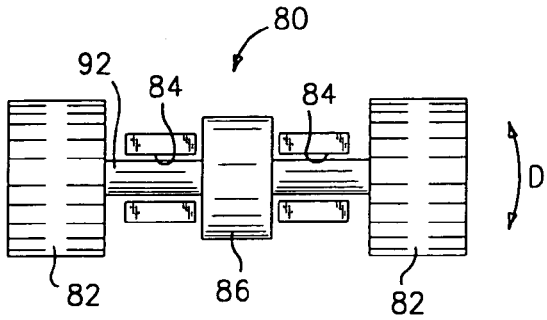
FIG. 11 is an end view of the prompter of FIG. 10.

In another embodiment of the invention, shown in FIGS. 10–11, a prompter 80 generally like that previously described is provided with two spaced apart wheels 82, preferably with ribbed surfaces like the preferred prompter belt. The wheels are fastened to axle 92 at the body first end 83. The belt 86, which in this case does not need to have ribs, is driven by a drive roller at the unshown second end of the prompter body 90, and rotates first roller 87 and thereby axle 92. Axle 92 sits in a square bottom concave slot 84 in each leg of the bifurcated first end of the body. The width of the slot is chosen to be larger than the diameter of the axle 92, so the axle and attached wheels may rotate slightly in the cross sectional plane transverse to longitudinal axis 94 of the body, as indicated by the arrow D in end view FIG. 11. Thus, at the upstream end, there are two spaced apart points of contact of the prompter with the sheet, compared to the single central point of contact in a prompter without wheels. As a result, the two-wheel prompter is better suited to contact uneven surfaced sheets or accommodate misalignment of the infeed table. It more surely moves sheets in the desired flow path direction. Of course, more than two wheels may be used.

Figure 13:
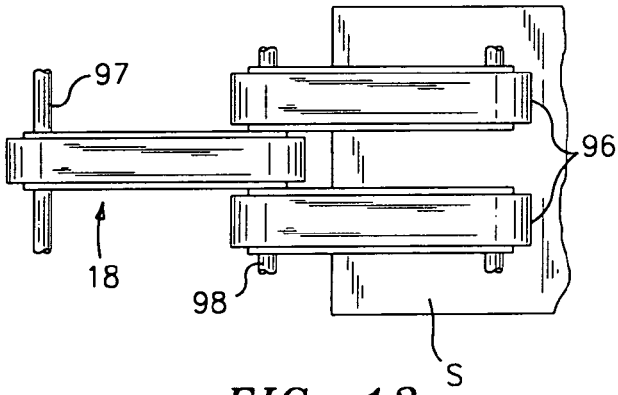
FIG. 13 is a top view of the prompter assembly of FIG. 12.
Figure 12:
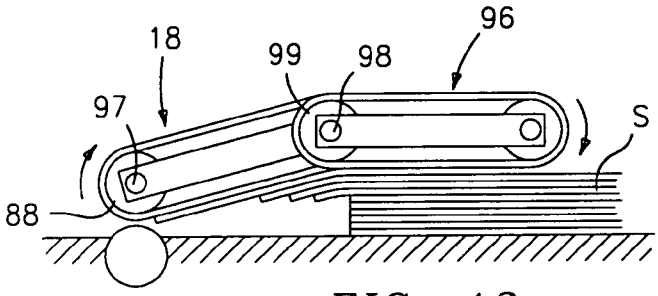
FIG. 12 is a side view of a duplex prompter assembly.

In another embodiment, two or more prompters may be mounted in serial fashion, as illustrated by side view FIG. 12 and top view FIG. 13. Primary prompter 18 has a second end, or idler, roller fastened to an axle 98; and, two secondary prompters 96, or less preferably only one, have their driven first end roller 99 fastened to axle 98. Thus, driving the first roller 88 of prompter 18 by rotating shaft 97, as previously described, drives all prompters, to remove sheets from stack S. Of course, prompters may be used in parallel multiples.

The prompter embodiments which are described here may be positioned so the body length lies at a small angle to the flow path centerline. Thus, sheets engaged by the prompter are substantially moved along the flow path, but are given a sideways motion component, to direct them against a rail when justification is desired.

Figure 17:
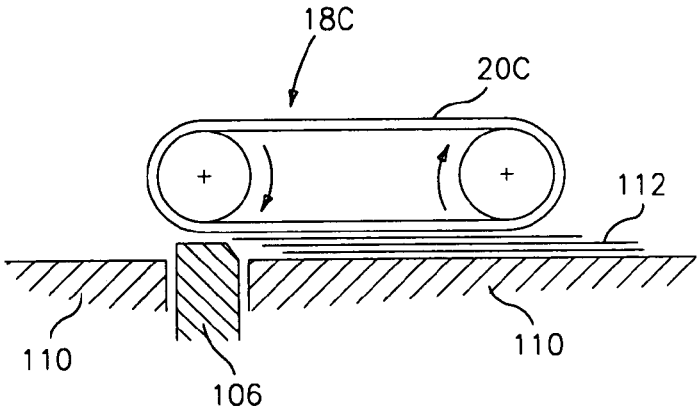
FIG. 17 is a side view of a prompter used as a singulator.

The prompter device we describe above can be used independently of the other mechanisms to feed sheets. It can also be used as a singulator itself. As an example, semi-schematic FIG. 17 shows the prompter 18C having a construction similar to that described for the prompter of FIG. 1. It is positioned to rotate down onto surface 110 where lies a stack of sheets 112. An adjustable retard surface 106, such as a pad or roller, lies beneath the underside of belt 20C at the downstream roller end, about which the prompter pivots. In operation, the prompter belt moves sheets from a varying height stack on the infeed table, to vicinity of the retard surface 106, where the sheets are singulated.

Figure 15:
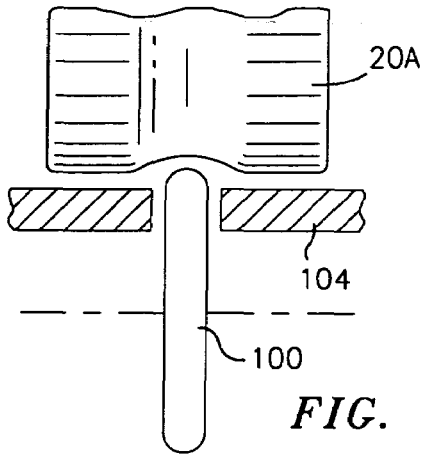
FIG. 15 shows how a grooved prompter belt forms a singulating nip with a retarder.
Figure 16:
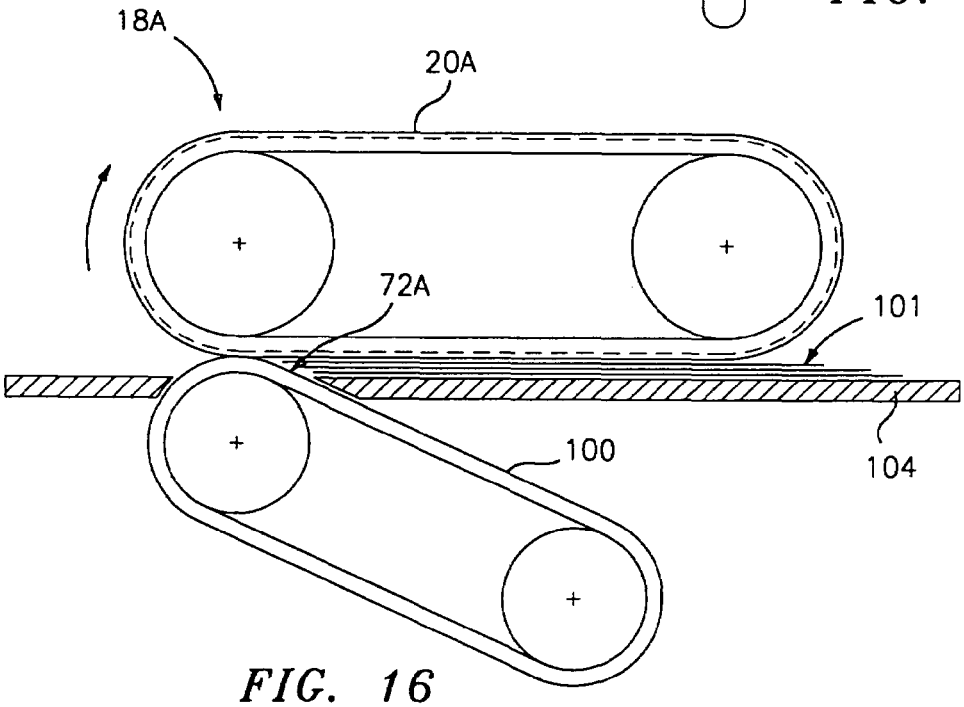
FIG. 16 shows the apparatus of FIG. 15 in side view, as it singulates sheets.

In an analogous arrangement, FIGS. 14–16 shows how a prompter with a belt 20A having a lengthwise groove 102 singulates sheets when mated with a retard device, such as stationary belt 100. As shown in end view FIG. 15 and side view FIG. 16, the prompter 18A with a grooved belt 20A mounts above the sheet flow path and surface of table 104, while the retard belt 100 projects from beneath the surface of the table up into the groove. The retard belt 100 does not contact the prompter belt 20A, and thus there is no resultant wear. Other known forms of retard device, such as a static wheel, may be substituted for the belt 100. When a sheets 101 enter the singulator nip 72A, the top sheet is deformed upward and into the groove, and then moves downstream. Any underlying sheet which seeks to also pass through the nip at the same time is prevented from doing so by contact with the retard belt.

Figure 19:
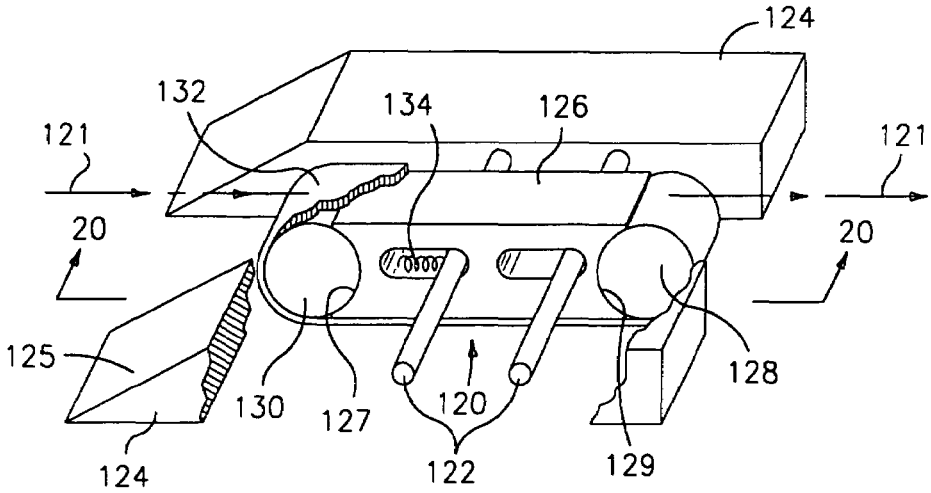
FIG. 19 is a perspective view of a retarder called a dancer and its mounting.
Figure 20:
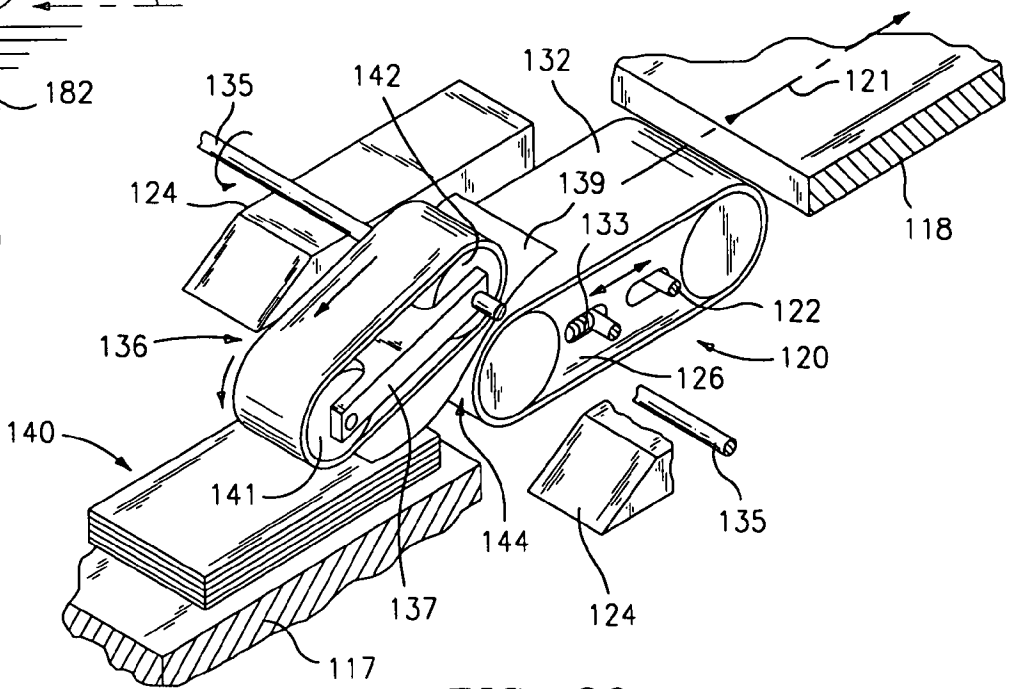
FIG. 20 is a side view of the dancer mechanism of FIG. 19 in combination with a belted singulator driver, called a prompter, as sheets are being fed.

A preferred retarder 120, called a dancer herein, is shown in perspective in FIG. 19. In FIG. 20 it is shown in combination with a prompter 136, as it forms a singulator through which sheets are being passed. The dancer 120 is linearly movable lengthwise, back and forth along the sheet flow path 121 downstream of the singulator nip 144, when it interacts with sheets which pass through the nip. A built in spring biases the dancer in the upstream direction, against the direction of sheet flow, so in the rest position, the dancer is less than one sheet thickness away from, or in light contact with, the prompter.

The dancer of FIG. 19 comprises a slotted lightweight plastic body 126 mounted on spaced apart rods 122 which are fixedly attached to spaced apart guide blocks 124. The surfaces of the guide blocks function in the same manner as does outfeed table 118, while the upstream faces 125 of the blocks are sloped to guide sheets to the singulating nip 144. The sloped faces 125 enable the infeed table 117 to be set at a lower elevation than the dancer top, as shown; and, with the prompter enable a varying amount of sheets to be in stack 140, avoiding possible problems relating to inconstant delivery of sheets to the infeed table.

Each rod 122 passes through a slot 133 in the dancer body 126. Captured within the upstream slot is compression spring 134, pressing on the body and rod 122. At opposing first and second ends of the body are semi-circular concavities 127 and 129, into which fit opposing plastic rollers 130, 128. An endless and flat elastomer belt 132 is stretched about 3% in length, to around the rollers and the body, thus retain the rollers 128, 130 in place. The belt has a surface suited to frictionally engage the sheets being processed, for example 30–60 Durometer polyurethane, in accord with the prior art for retarders. Due to the tension in the belt and the friction of the rollers in their concave end journals, the rollers do not move freely, and the belt remains stationary during the feeding of sheets through the nip.

FIG. 20 shows a prompter like that described for FIG. 1. It is comprised of body 137, and opposing end rollers 141, 142, over which is stretched belt 138. Roller 142, which preferably does not have an integral one-way clutch like some prompters, is driven by rotation of shaft 135, thus moving the belt, as indicated by the arrows. The prompter belt at roller 142 cooperates as a driver with the retarder to form the singulator 133 having nip 144. The prompter belt motion at roller 141 and along the underside of the body 137 brings sheets to the nip from stack 140.

The spring 134 has a spring constant of about 250 gm/cm and applies relatively modest force to the body. Thus, the body is easily moved by finger touch. The retarder is preferably positioned vertically and horizontally so that when the spring translates it horizontally it hits the prompter, as elaborated on below. The spring bias force is sufficiently slight that any wear between the prompter belt and retarder belt is trivial. Alternately, a stop may be used to limit the degree of horizontal bias of the retarder, so it is very close to but not touching the driver (prompter), e.g., with a singulator gap spacing of 100 percent or less of the thickness of the anticipated thinnest article to be processed.

FIG. 20 shows how top sheet 139 is caused by the prompter belt to pass through the nip 144. As the sheet does so, the retarder 120 is thrust slightly downstream (to the right in the Figure) against the bias of spring 134, thus opening up the gap at the nip, which is otherwise too thin for the sheet. The spring bias force is chosen to be sufficient to keep the retarder from moving downstream excessively, so the desired gaging or singulating action takes place. Thus, the retarder blocks any underlying sheet which is dragged to the nip from passing through. It is seen that the gap is automatically set precisely, according to the thickness of the sheet passing through the nip.

The retarder dances back and forth according to whether a sheet is in the nip or not, and according to what the sheet thickness is. Thus, we refer to this style retarder as a "dancer". Another advantage to the dancer will be appreciated from discussion below about the angle at which sheets pass through the singulator, compared to the movement direction of the dancer.

Figure 21:
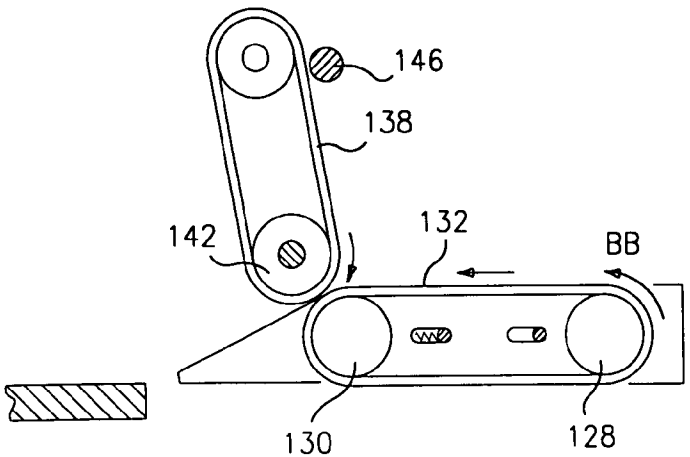
FIG. 21 is a schematic view similar to what is shown in FIG. 20, showing how, when the prompter drive direction is reversed the retarder belt is moved.

The surface of the dancer belt 132, as with other retarders, is prone to wear and accretion of debris. When the dancer is positioned so it contacts the driver in the absence of a sheet in the nip, the dancer belt may be renewed at the nip by periodically reversing the direction of the driver. As shown by FIG. 21, reversal of rotation of roller 142 causes the prompter-driver to pivot upwardly until it hits an optional idler pulley stop 146. Continued rotation further engages the prompter belt 138 with the dancer belt 132, as the dancer is pulled upstream. Then, the resistance of dancer belt 132 to motion is overcome, and the top surface of the dancer belt is moved upstream as indicated by arrow BB, by an amount determined by the time of reversal. Alternately, the prompter stop can be eliminated, and the prompter will flop over on top of the retarder belt 132, to accomplish the same result.

Figure 22:
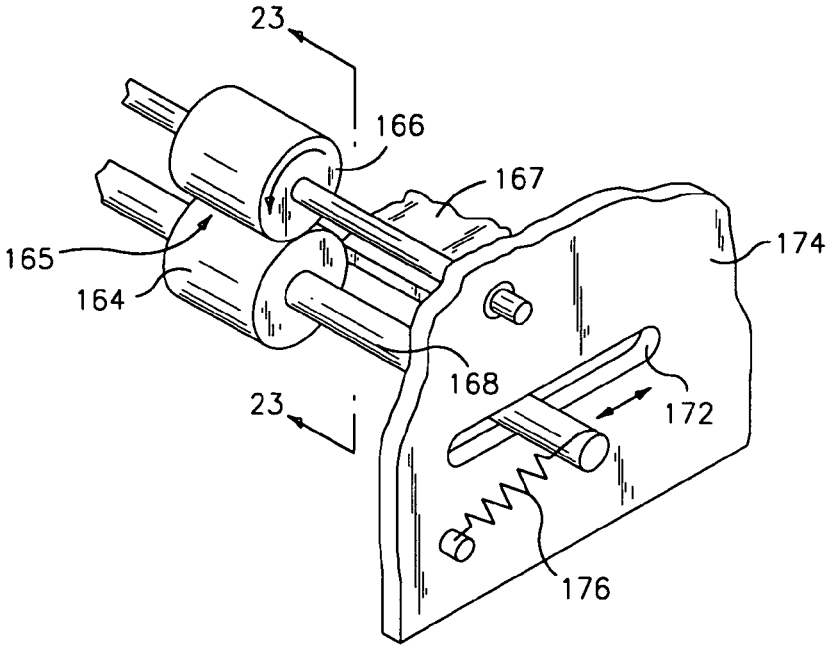
FIG. 22 shows in fragmentary perspective another embodiment of dancer.

The perspective view of FIG. 22 illustrates another embodiment of the invention where the dancer comprises a non-rotatable retard roller 164 fastened to shaft 168. Shaft 168 mounts at either end in typical horizontal slot 172 in the apparatus sidewall 174. Typical tension spring 176 biases the shaft, and thus the dancer upstream. The dancer cooperates with rotating drive roller 166 to form a singulator nip 165.

Figure 23:
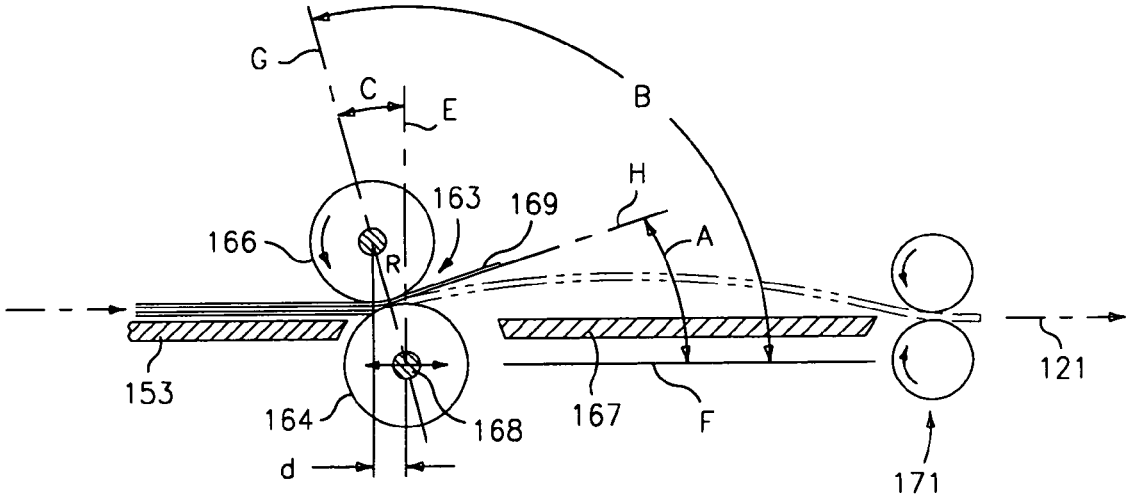
FIG. 23 is a side view of portions mechanism of FIG. 22, with feed tables, to illustrate the geometric relations between the components.

FIG. 23 shows the same driver and dancer as in FIG. 22, with infeed and outfeed tables 153, 167; and, it shows how sheets pass through the nip, moving the dancer downstream. FIG. 23 also illustrates geometric relationships generally applicable to dancers, including dancer 126 in FIG. 19. They are important when sheets are being taken away from the singulator by a downstream device faster than dictated by the feed roller 166.

FIG. 23 shows feed roller 166 and dancer 164 are vertically spaced apart so the dancer interferes with the roller, or a sheet in the nip at the roller, when the dancer moves horizontally along its travel path F. Upon interference contact with the roller, or any sheet in the nip, the dancer centerline is a horizontal distance d downstream of the roller plumb line. Accordingly, Line G, which connects the centers of feed roller and retarder, slopes upstream at angle C with respect to the vertical axis E. Radius R of feed roller 166 runs along the line G, as it is that radius which is perpendicular to the tangent of the feed roller, which tangent is parallel to the surface of typical sheet 169 when it is in the nip. (This principle will apply when the retarder is non-circular.) More generally, the line G and radius R are at an angle B of greater than 90 degrees to dancer travel path F, typically about 15–30 degrees. The foregoing geometries cause typical sheet 169, as it passes through the singulator, to run upwardly along a line of travel H, which has an angle A to path F. Angle A is nominally equal to angle C.

Thus, in the generality of the invention, the sheet moves along a horizontal flow path 121 downstream of the singulator. The overall sheet flow path is generally horizontal, but for the local deviation for transit through the nip 163. As typical sheet 169 passes through the singulator nip it moves along a travel path which is angled upwardly from the generally horizontal flow path. As the sheet moves out of the nip, it bends over from its diverging local path and back down to the elevation of outfeed table 167, to engage takeaway rollers 171, as illustrated by the phantom sheet 173. The takeaway rollers 171 pull the sheet again along the essential horizontal flow path and, thus, generally parallel to the horizontal line F of dancer translation. Corollaries to the foregoing are: The takeaway direction is at an angle to the tangent to the sheet surface in the nip. The dancer travel path is at an angle to the tangent to the sheet surface in the nip. It will be appreciated that in other embodiments, the same essential geometric relations will obtain if the dancer is sloped or vertical in space.

When the foregoing geometry obtains, and the takeaway device pulls on the sheet, the dancer will move downstream against the spring bias, desirably lessening the frictional engagement in the nip due to interaction of the roller and the dancer. Thus, sheets are less prone to smearing or wear.

Other geometries are less preferred, but useful. For example, the driver and dancer may be vertically spaced apart so there is no interference between the two components, when the driver is positioned along a plumb line directly above the front end of the dancer, with upstream travel limited by a stop, and the nip gap set at less than the thickness of anticipated sheets.

Figure 24:
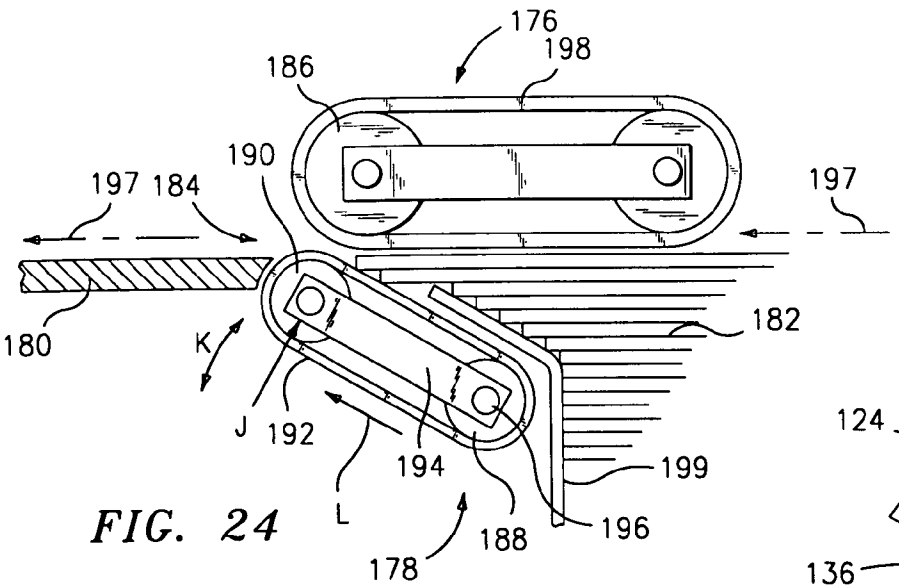
FIG. 24 is a side view of a singulator comprised of a prompter in combination with a pivotable retarder.

FIG. 24 shows still another embodiment, dancer 178 which moves during sheet feeding with a rotatable motion. Prompter 176, constructed like previously described prompter 136, acts as a combination feeder and singulator driver, as previously described for FIG. 20. The stack 182 periodically is fed upwardly by an unshown elevator, as sheets are removed from the top of the stack. In this embodiment, as sheets are drawn through the nip 184 from a stack 182, the motion of the dancer continuously and automatically changes the portion of the belt presented at the singulator nip 184.

Preferably, dancer 178 is constructed similarly to prompter 176, as shown in FIG. 24. The dancer comprises a body 194, on which are mounted opposing end rollers 188, 190. Both rollers, and at least roller 188, have integral one-way clutches. A belt 192 is stretched around the rollers. It mates with prompter belt 198 to form the nip 184 at roller 190. The body is pivotably mounted at one end on fixed shaft 196, and biased to rotate in the vertical plane toward the prompter by a resilient force represented by the vector J, so the dancer belt touches or nearly touches the prompter belt 198. The force J may be provided by a variety of means, for example, by a torsion spring mounted around shaft 196. Shield 199 prevents all but the uppermost of the sheets of stack 182 from contacting the dancer and interfering with its dancing motion.

In operation, when a sheet passes through the nip to the horizontal plane output table 180, the dancer is rotated slightly away from the prompter, and then back, as indicated by the arrow K. When the body 194 pivots to open the nip, the one-way clutch prevents corresponding rotation of roller 188, and thus the belt moves relative to the body, as indicated by the arrow L. When the body swings back to its rest position the belt motion is preserved by action of the one-way clutch, again, and the belt advances an increment.

Because of the geometry shown in the FIG. 24, when the dancer 178 pivots, the end at roller 190 which forms the nip has a horizontal component of motion. That translational component is thus parallel to the general flow path 197 of the sheet, which is a common feature the pivoting dancer has with the linear motion dancers previously described. In the generality of the FIG. 24 invention, the dancer may be a monolithic member having a suitable friction surface.

Still another aspect of the invention relates to how sheets are taken away, across the outfeed table, at a second speed, faster the first speed at which they are delivered to the outfeed table, to thereby increase their spacing.

Figure 25:
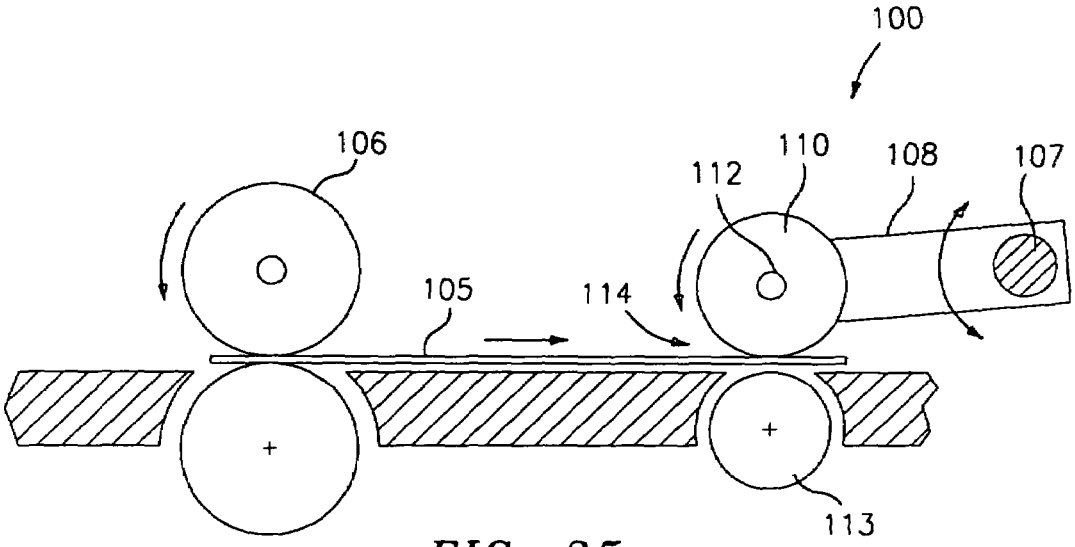
FIG. 25 shows in elevation view a takeaway mechanism which employs a low moment of inertia motor and roller assembly.
Figure 26:
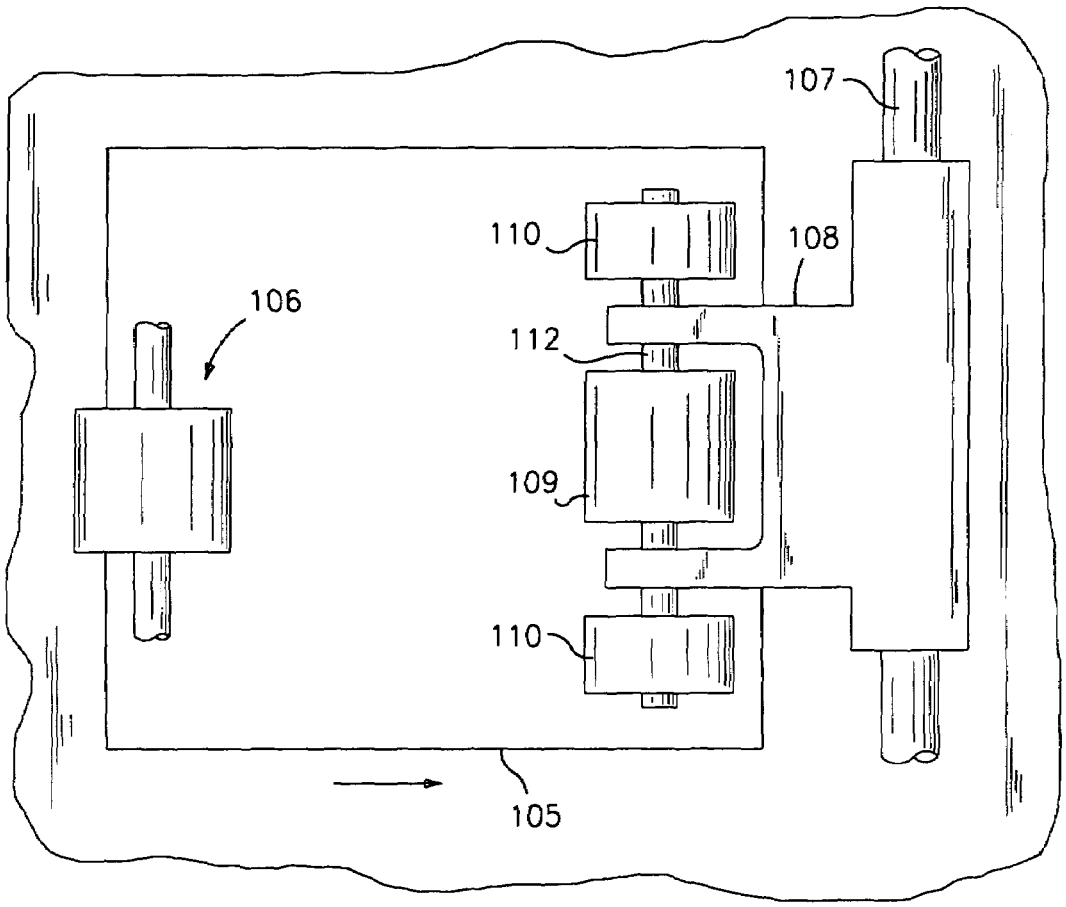
FIG. 26 is a top view of the mechanism shown in FIG. 25.

In the invention, as illustrated by side view FIG. 25 and top view FIG. 26, a sheet 105 passing through a singulator 106 is acted on by the takeaway device 100 comprised of high friction drive roller 110 and idler roller 113. Dual rollers 110, fabricated with lightweight material and construction, and mounted on motor shaft 112 are directly driven by motor 109. The rollers, which have a high coefficient of friction to engage sheets, and the motor are attached to bracket 108 which is pivotably mounted on support shaft 107. Motor 109 is specially chosen for low moment of inertia and torque control character.

The power to the motor is set to impart to the rollers 110 a torque which is insufficient to break loose the rollers when it pulls on a sheet which resists movement at higher speed because it is still engaged with the upstream singulator 106. The combination of motor and rollers 110 is chosen for a polar moment of inertia sufficiently low to enable the motor and rollers to sharply and substantially decrease rotational speed, when a slow moving sheet enters nip 114 of takeaway device 100. So, the surface speed of the roller nearly instantly corresponds with the nominal first speed of the sheet. Thus, there is negligible slippage at either the takeaway nip 114 or the singulator 106.

Although only the preferred embodiment has been described with some alternatives, it will be understood that further changes in form and detail may be made without departing from the spirit and scope of the claimed invention.

We claim:

1. Article feeding apparatus of the type in which flat articles such as sheets are moved downstream along an article flow path, including a prompter for moving articles along the flow path, wherein the prompter comprises:

a shaft, extending transversely to the flow path;

a first roller, mounted on the shaft;

a body, having a first end and second end lying along the body length; the first end pivotably engaged with the shaft proximate the first roller;

a second roller, mounted at the second end of the body;

a belt, mounted on and endlessly running around the first and second rollers, having a surface which frictionally engages and moves downstream an article along the flow path, when the body second end is positioned upstream of the first end;

means for moving the belt around the rollers and thus rotating the rollers; and, means for imparting to the body a first moment created by a rotary friction force applied directly to the body; wherein the first moment urges the body to rotate around the shaft and thereby press at the second roller end against any article lying along the flow path;

wherein said frictional engagement of the belt with an article moving downstream along the flow path, due to the motion of the belt running around the rollers, imparts to the body a second moment, distinct from the first moment, which urges the body to rotate in the same direction as the first moment;

wherein the means for moving the belt comprises a first roller driven by rotation of the shaft; and, wherein the body first end is bifurcated to straddle the first roller and frictionally engage the rotating shaft, thereby to create said first moment.

2. The apparatus of claim 1 wherein the belt is made of elastomer and is stretched between the rollers, so tension in the belt holds the body in frictional and pivotable engagement with the shaft, to thereby create said first moment.

3. The apparatus of claim 1 wherein the belt has a surface comprised of a plurality of transverse ribs with cross sections which make the ribs substantially deflectable when the belt pulls an article along the flow path.

4. Article feeding apparatus of the type in which flat articles such as sheets are moved downstream along an article flow path, including a prompter for moving articles along the flow path, wherein the prompter comprises:

a shaft, extending transversely to the flow path;

a first roller, mounted on the shaft;

a body, having a first end and second end lying along the body length; the first end pivotably engaged with the shaft proximate the first roller;

a second roller, mounted at the second end of the body;

a belt, mounted on and endlessly running around the first and second rollers, having a surface which frictionally engages and moves downstream an article along the flow path, when the body second end is positioned upstream of the first end;

means for moving the belt around the rollers and thus rotating the rollers; and, means for imparting to the body a first moment created by a rotary friction force applied directly to the body; wherein the first moment urges the body to rotate around the shaft and thereby press at the second roller end against any article lying along the flow path;

wherein said frictional engagement of the belt with an article moving downstream along the flow path, due to the motion of the belt running around the rollers, imparts to the body a second moment, distinct from the first moment, which urges the body to rotate in the same direction as the first moment;

wherein, the article flow path lies along a plane; further comprising a shingled stack of sheets lying along said plane; wherein the prompter second roller lies above the stack at an elevation higher than the elevation of the first roller and higher than the elevation of said plane.

5. Article feeding apparatus of the type in which flat articles such as sheets are moved downstream along an article flow path, including a prompter for moving articles along the flow path, wherein the prompter comprises:

a shaft, extending transversely to the flow path;

a first roller, mounted on the shaft;

a body, having a first end and second end lying along the body length; the first end pivotably engaged with the shaft proximate the first roller;

a second roller, mounted at the second end of the body;

a belt, mounted on and endlessly running around the first and second rollers, having a surface which frictionally engages and moves downstream an article along the flow path, when the body second end is positioned upstream of the first end;

means for moving the belt around the rollers and thus rotating the rollers; and, means for imparting to the body a first moment created by a rotary friction force applied directly to the body; wherein the first moment urges the body to rotate around the shaft and thereby press at the second roller end against any article lying along the flow path;

wherein, the belt has a surface comprised of a plurality of transverse ribs with cross sections which make the ribs substantially deflectable when the belt pulls an article along the flow path; and, wherein each rib in said plurality of ribs has a cross section which is rectangular and has a height to width aspect ratio of between about 1.3:1 and 4:1.

6. Article feeding apparatus of the type in which flat articles such as sheets are moved downstream along an article flow path, including a prompter for moving articles along the flow path, wherein the prompter comprises:

a shaft, extending transversely to the flow path;

a first roller, mounted on the shaft;

a body, having a first end and second end lying along the body length; the first end pivotably engaged with the shaft proximate the first roller;

a second roller, mounted at the second end of the body;

a belt, mounted on and endlessly running around the first and second rollers, having a surface which frictionally engages and moves downstream an article along the flow path, when the body second end is positioned upstream of the first end;

means for moving the belt around the rollers and thus rotating the rollers; and, means for imparting to the body a first moment created by a rotary friction force applied directly to the body; wherein the first moment urges the body to rotate around the shaft and thereby press at the second roller end against any article lying along the flow path;

wherein said frictional engagement of the belt with an article moving downstream along the flow path, due to the motion of the belt running around the rollers, imparts to the body a second moment, distinct from the first moment, which urges the body to rotate in the same direction as the first moment;

the apparatus further comprising:

two opposing sidewalls, one each on either side of said flow path;

opposing mounting blocks, one each block slidably and detachably mounted on an opposing sidewall;

wherein the shaft is journaled at opposing ends in the mounting blocks; wherein, each block is vertically slidable along its respective sidewall, to enable adjustment of the vertical position of each end of the shaft;

resilient means for pressing each mounting block downwardly toward the sidewall; and, screw adjustment means associated with each mounting block, for causing the mounting block to move vertically in opposition to downward force of said resilient means.

7. Article feeding apparatus of the type in which flat articles such as sheets are moved downstream along an article flow path, including a prompter for moving articles along the flow path, wherein the prompter comprises:

a shaft, extending transversely to the flow path;

a first roller, mounted on the shaft;

a body, having a first end and second end lying along the body length; the first end pivotably engaged with the shaft proximate the first roller;

a second roller, mounted at the second end of the body;

a belt, mounted on and endlessly running around the first and second rollers, having a surface which frictionally engages and moves downstream an article along the flow path when the body second end is positioned upstream of the first end;

means for moving the belt around the rollers and thus rotating the rollers; and, means for imparting to the body a first moment created by a rotary friction force applied directly to the body; wherein the first moment urges the body to rotate around the shaft and thereby press at the second roller end against any article lying along the flow path;

wherein, the belt has a surface comprised of a plurality of transverse ribs with cross sections which make the ribs substantially deflectable when the belt pulls an article along the flow path; and, wherein each rib in said plurality of ribs has a cross section which is triangular and has a height to width aspect ratio of between about 2:1 and 4:1.

* * * * *